US007335101B1

(12) United States Patent
Luciano, Jr.

(10) Patent No.: US 7,335,101 B1
(45) Date of Patent: Feb. 26, 2008

(54) ELECTROLUMINESCENT DISPLAY FOR GAMING MACHINES

(75) Inventor: Robert Anthony Luciano, Jr., Reno, NV (US)

(73) Assignee: Sierra Design Group, Las Vegas, NV (US)

( * ) Notice: Subject to any disclaimer, the term of this patent is extended or adjusted under 35 U.S.C. 154(b) by 114 days.

(21) Appl. No.: 10/119,279

(22) Filed: Apr. 8, 2002

Related U.S. Application Data

(63) Continuation-in-part of application No. 10/045,192, filed on Oct. 18, 2001, now abandoned.

(51) Int. Cl.
*A63F 9/24* (2006.01)

(52) U.S. Cl. ..... 463/16; 463/42

(58) Field of Classification Search ..... 463/16, 463/20, 21, 22, 30, 31; 273/138.1, 139, 143 R
See application file for complete search history.

(56) References Cited

U.S. PATENT DOCUMENTS 5,239,227 A * 8/1993 Kikinis ..... 313/506
5,580,055 A 12/1996 Hagiwara
5,752,881 A * 5/1998 Inoue ..... 463/20
5,807,172 A * 9/1998 Piechowiak ..... 463/20
5,848,932 A 12/1998 Adams
6,027,115 A 2/2000 Griswold et al.
6,033,307 A * 3/2000 Vancura ..... 463/20
6,200,217 B1 * 3/2001 Osawa ..... 463/20
6,322,309 B1 * 11/2001 Thomas et al. ..... 413/20
6,517,433 B2 * 2/2003 Loose et al. ..... 463/20

* cited by examiner

*Primary Examiner*—Robert E. Pezzuto
*Assistant Examiner*—Robert Mosser
(74) *Attorney, Agent, or Firm*—Russ F. Marsden; Andrew B. Chen; J. P. Cody

(57) ABSTRACT

A new apparatus and method for use in a casino-type gaming machine, allowing enhanced identification of winning pay-lines by a player. Specifically, the present invention provides for the use of at least one electroluminescent display in a location at, dispersed within, or very near the slot reel (or reel tape) display area. Using these electroluminescent displays, a new and far superior display for showing winning pay lines with visual accents both near and running across the front of physical reels or reel tapes reels is disclosed.

19 Claims, 7 Drawing Sheets

Paying Indicia Combinations
Using Electroluminescent Displays
According To The Present Invention Schematic TFEL Display Structure EL Display Location
In Accordance With The
Present Invention Indicators According To The Present Invention Gaming Machine
Front Panel Glass With
TFEL Panels According
To The Present Invention Paying Indicia Combinations
Using Electroluminescent Displays
According To The Present Invention Method For Using Electroluminescent Displays In A Gaming Machine.

Method For Using Electroluminescent Displays In A Gaming Machine.

ELECTROLUMINESCENT DISPLAY FOR GAMING MACHINES

RELATED APPLICATIONS

This application is a continuation-in-part of application Ser. No. 10/045,192 having filing date Oct. 18, 2001 now abandoned and entitled "Electroluminescent Display For Gaming Machines".

This application is related to co-pending U.S. patent application Ser. No. 10/119,324, filed on Apr. 8, 2002, entitled GAME USING ELECTROLUMINESCENT DISPLAY ON REEL PANEL.

BACKGROUND OF THE INVENTION

1. Field of the Invention

This invention pertains generally to gaming machines. More particularly, the present invention discloses a method and apparatus for providing gaming machines with enhanced payline indicators, attract mode features, and additional game play opportunities using electroluminescent displays.

2. The Prior Art

Traditional Las Vegas style slot machines are generally well known. In particular, the slot machines have a display area visible to a player that allows viewing of either physical slot reels, reel strips, or video displays showing pseudo-reels. The reels either spin or appear to spin, stopping with various game indicia visible to the user through a viewing area or display. A typical display will show a set of individual indicia in a matrix (column×row) format. A typical slot may have one of many typical indicia patterns visible to a player, such as 3 indicia vertically and 3 indicia horizontally (3×3) for a total of 9 indicia showing, 3 vertical and 4 horizontal (3×4) for a total of 12 indicia showing, and so forth.

If the gaming machine uses slots or reel strips, methods of indicating winning paylines to a player have been limited due to the physical construction of the display area. Playable paylines are typically made part of the game glass that sits over the visible game indicia. In these cases, the possible paylines are simply colored pointers or lines that a player uses to determine for themselves (depending on the wager) if they have won or not, after the reels stop. They provide little in the way of helping a player recognize winning paylines; payline recognition must be done by the player.

Some games have been fitted with backlighting to try and indicate paylines, but backlighting (using small incandescent light bulbs encased within plastic cells facing towards the front panel, shining through the top glass) has limited functionality. Due to lack of space, back lighting may be used to illuminate one or perhaps two predefined payline options, but little else. In addition, such methods are not usable between reels due to space limitations.

Gaming machines using pure video displays have a slightly better ability to show paylines. Because video displays can be programmed to the pixel level, wining paylines may be displayed on the video screen showing lines that appear to be on top visible game indicia to indicate paylines. This is an improvement over gaming machine using reels or reel tapes, but cannot be used to show or indicate anything outside the viewing area. In addition, this apparatus has no applicability to physical reel and reel tape machines, leaving them without any payline indicators other than passive glasswork.

Further, all of the above illumination methods cannot provide for player attract mode in the display area.

Thus, there is a need for a better method of showing potential paylines to a player, indicating paying paylines, and providing player attract modes in the gaming machine area immediately around the visible game indicia.

BRIEF DESCRIPTION OF THE INVENTION

The present invention provides for a significant improvement in the display of winning game symbol combinations to a player upon the occurrence of a winning game event in a gaming machine. This is especially true when the gaming machine uses physical reels or reel tape.

At least one electroluminescent display is operably attached to, and connected within, a gaming machine. Internally, an electroluminescent (EL) driver is operably connected between a CPU within the gaming machine and the EL display, the EL driver actually being used determined by the particular implementation. Software running in the game machine's CPU and memory will create images to display on the EL display in a manner similar to other display devices in the sense that EL displays enable pixel addressing. This allows the known engineering solutions used for other pixel addressable displays to be used with EL displays.

The images created by the software and displayed to the user are primarily for the use of enhancing the visual connection between winning game symbols displayed on reels, or in a game results display area. These images can be very varied. One preferred embodiment will use the displays to show winning game events as dynamically displayed connecting lines between game symbols that make up a winning combination. Another preferred embodiment will use color, partially surrounding each game symbol, as an indicator of combinations of winning game symbols. This embodiment further enables new winning game symbol combinations not previously available.

BRIEF DESCRIPTION OF THE DRAWINGS

FIG. 3 illustrates a gaming machine front panel with TFEL panels according to the present invention.

DETAILED DESCRIPTION OF PREFERRED EMBODIMENTS

Figure 1:
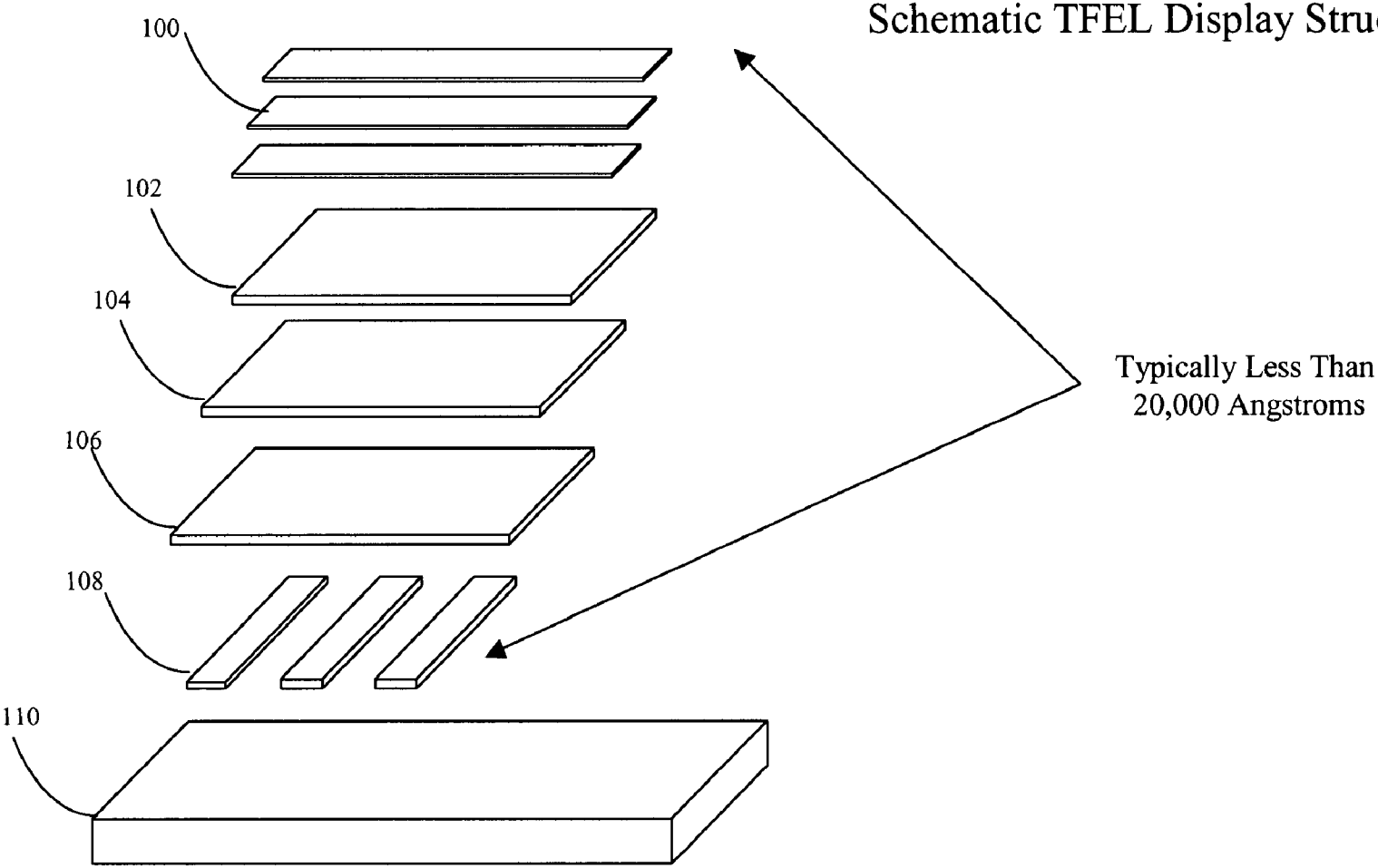
FIG. 1 is a schematic diagram of a TFEL display's structure.

Persons of ordinary skill in the art and with the benefit of the present disclosure will realize that the following description of the present invention is illustrative only, and is not limiting. Other embodiments of the invention will readily suggest themselves when such skilled persons have the benefit of the present disclosure.

Referring to the drawings, for illustrative purposes the present invention is shown embodied in FIGS. 1 through 7. It will be appreciated that the apparatus may vary as to configuration and as to details of the parts without departing from the inventive concepts disclosed herein. The methods may vary as to details, partitioning, repetition, step inclusion, and the order of the acts, without departing from the inventive concepts disclosed herein.

FIG. 1 is a schematic diagram of an TFEL display (thin film electroluminescent display). Layers 100 through 108, making up the primary layers of a TFEL, are deposited on a glass substrate 110 (clearly the illustrated thicknesses are not scale). There are electrodes 100, insulator 102, phosphor layer(s) 104, another insulator layer 106, and another electrode layer 108. This would be typical for a monochrome display; color displays would have an additional filtering layer (RGB filters) between the display glass (viewing direction) and the first layer of electrodes. The specifics of TFEL display making and driving are known in the TFEL art; important TFEL characteristics for the purposes of the present disclosure are discussed below.

One key property of TFELs is their thin construction. All the layers applied to a substrate have a typical combined thickness of 20K Angstroms or less, even when color filters are added to FIG. 1. As an Angstrom is $10^{-8}$ centimeters, the entire display may be less than $2\times10^{-4}$ centimeters thick (this will depend on phosphor layer(s) used and any additional RGB filters for color displays, but the order of magnitude is the important part for purposes of this disclosure). Even adding the glass substrate together with the control structures needed for a standard commercial electroluminescent display package, the entire display panel may be in the range of 4 mm to 20 mm in total thickness (approximately 0.2 to 0.8 inches). Compared to the rest of the mechanisms in a reel gaming machine or reel tape gaming machine, this thinness allows the placement of the display panels virtually anywhere, as they will not interfere with the reel mechanisms. In addition, electroluminescent panels may be used in conjunction with a video display by placing electroluminescent panels around the boundaries of the video display. This allows TFEL (thin film electroluminescent) displays, mounted on the front panel of a gaming machine and visible to a player, to be placed literally anyplace on the display area that does not obstruct they player's view of the game indicia (reels, reel tape, or video display). This is new, allowing dynamic displays in physical areas on gaming machines, particularly reel and reel tape machines, not previously possible.

Figure 2:
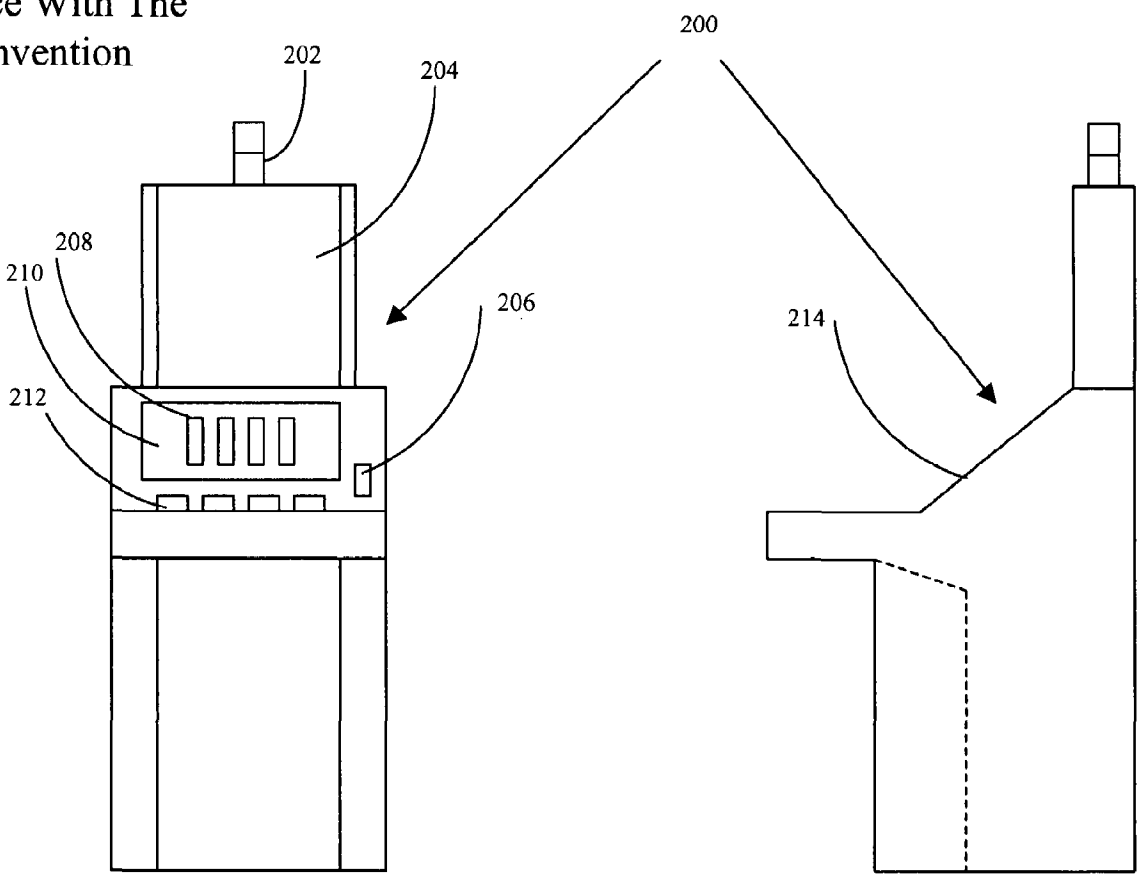
FIG. 2 shows the location of an electroluminescent display area in a gaming machine accordance with the present invention.

FIG. 2 shows a typical location for one or more electroluminescent displays visible to a player. A gaming machine 200 is shown in front and side views. Illustrated is a slant-top configuration, but the cabinet shape is for illustrative purposes only. Gaming machine 200 has the normal accoutrements, such as top candle 202, an upper (typically static) display 204, a plurality of player input/output devices, typically buttons, shown generally as 212, and an input slot 206. Input slot 206 may be a bill acceptor, voucher reader, player ID reader, or several of these in combination, as configured in any particular casino. Finally, the visible game indicia are shown as a series of four player visible areas, in this case slots 208, surrounding by game indicia display area 210. Display area 214 shows where game indicia area 210 would be located (approximately) when the gaming machine is viewed from the side. Note that the four slots 208 are representative only; there may be any number of slots or areas, or the game indicia area may be a single rectangle (or other shape), such as found on video-based gaming machines. In all cases, there will be an area 210 visually close to the game indicia area.

It is intended that area 210 be considered as two functional areas. The first functional area is such that when playing a gaming machine, the electroluminescent displays are placed so that a player, when viewing the images shown on electroluminescent displays, visually associates at least one image with a game indicia. The second functional area is close to the game indicia (still mounted on the reel panel of the gaming machine), but with enough visual separation such that images displayed are seen as applying to more than one game indicia.

A typical TFEL installation in a gaming machine will use either custom made or commercially available TFEL panels mounted on the underside of the gaming machine's display area glass 210, also called the reel panel for reel gaming machines (it is also possible to mount electroluminescent displays on top of the front panel area glass, but this is not expected to be the most popular configuration). There may be one or several individual panels, depending on the specifics of the images to be displayed and the gaming machines' current mechanisms. Further, a plurality of electroluminescent displays may be physical configured (attached in relationship to each other and the display area art) to appear as a single display to a player.

Since electroluminescent panels comprise displays were individual illumination points are addressable as pixels, the software engineering techniques used to create and send images to TFEL panels is a known task (the same as other pixel devices). The software generating the images is run on a graphics processor or general purpose processor and associated RAM in the gaming machine, together with the appropriate TFEL display driver or drivers for the specific application, which will result in an image visible to a player (these components not illustrated). The same techniques used for a single electroluminescent display are applicable to more than one display panel as well; the overall image or image(s) being managed by the same software.

Figure 3:
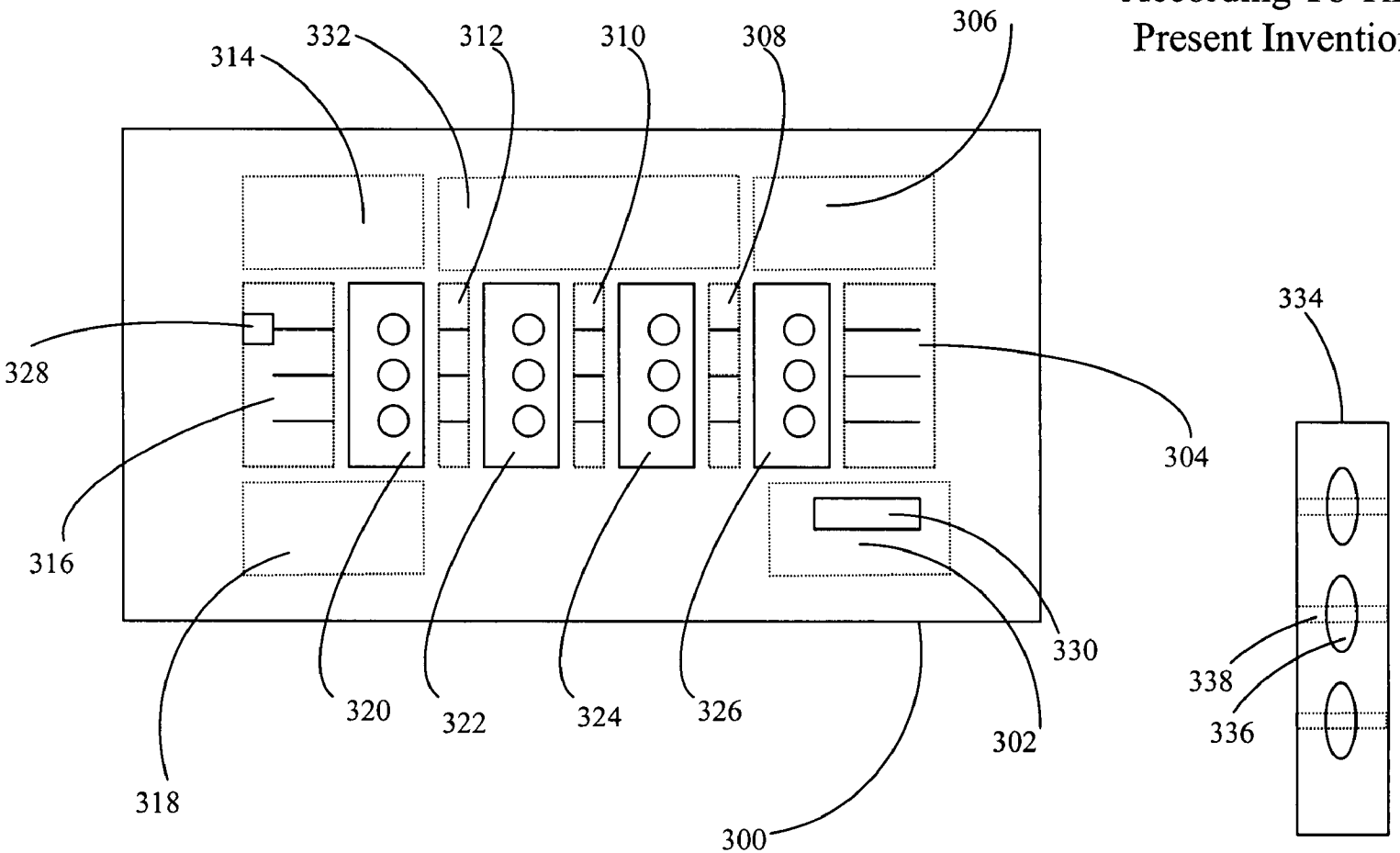
FIG. 3 illustrates payline indicators in accordance with the present invention.

FIG. 3 shows one embodiment of the present invention. Shown generally is game indicia display area 300, typically the front game panel or front panel glass (also called the reel display glass, reel panel, or reel display area glass). Typically this panel will be made of glass with opaque artwork covering the surface of the glass except for the "windows", or areas left transparent to allow player viewing of the reels (or reel tape) underneath the front panel, and the TFEL panels. In this example, there are four reel windows allowing a player to view underlying reels shown as 320, 322, 324, and 326. Each window allows a player to view 3 game indicia per reel, resulting in a 3×4 display (individual indicia shown generically as circles).

Electroluminescent panels 302, 304, 306, 308, 310, 312, 314, 316 and 318 have been placed in close proximity to the four game indicia display areas. Although shown as a collection of 9 panels, the actual number of panels will depend on the implementation. For example, there may be two end panels (302, 304 and 306 replaced with one panel "C" shaped panel, and similarly on the other end) and three intermediate panels. Note further that the panels may be installed on a common substrate, the unit then installed on a gaming machine. All such variations in the actual installation and implementation of electroluminescent panels is within the inventive scope of the present invention.

Since the electroluminescent displays are addressable in pixels, they are usable to shown paylines in a dynamic manner. Shown as solid lines within dotted-line electroluminescent display boxes 316, 312, 310, 308, and 304 are three of the possible paylines that may be enabled by a player using a gaming machine having the display area of FIG. 3. These three are shown to keep the illustration from becoming cluttered; any paylines connecting a plurality of game indicia may be shown to a player using the electroluminescent displays, and they may be in any configuration—they need not even go from edge to edge or cross all four reels. In addition, the present invention allows for the portion of the electroluminescent display shown as box 328 to contain the wagering amount currently being played; there would be an equivalent display area having wager amounts per payline. This enables not only the wagering amount in general to be shown, but further enables the amount wagered per line to vary; varying wagering per line has not previously been possible because there was no way to indicate individual payline wagering amount differences to the player. Now, it may be indicated by the color of the paylines or other methods, in addition to the wager-per-payline box 328 (there would be an equivalent box for each payline).

Another preferred embodiment will use small electroluminescent displays, similar to strips but actually long rectangles, to allow payline indicators to appear as if they cross game indicia. This is illustrated in window 334, having three game indicia 336 visible and each game indicia having in front of it (mounted on the window glass) a thin electroluminescent strip 338.

In the illustrated case, the pixels in the thin rectangular TFEL panels in front of the reels may be illuminated at will. The illumination may occur upon a winning event; it may be used in conjunction with a "help screen" (teaching mode) to show a player what paylines correspond to what bet amounts or what paylines a player may choose; or, they may be illuminated as a player makes wagering choices during game play. Since color is used in a preferred embodiment, the illuminated paylines may be further distinguished by using different colors for different paylines or wagering amounts.

This is expected to be helpful during payout events and initial wagering. Upon the occurrence of winning game indicia after a game play (meaning that the reels stop with game indicia in a specified physical relationship to each other, that combination of indicia and location defined as a winning combination; in old reel games this was limited to a set of three symbols in a line), the winning combinations of individual game indicia may now be illustrated to the player in real time and dynamically. This was not previously possible with reel or reel tape machines. In addition to the per-payline wagering amounts being displayed as discussed above, a preferred embodiment will further use an area of an electroluminescent display shown as box 330 to show the player their current game status which may include but is not limited to current amount wagered, amount won, credits, varying pay table options, and other useful data.

Note that a further use of electroluminescent displays 314, 306, 318, and 302 are as additional player attract mode displays. This becomes especially useful with the addition of a further electroluminescent display located between 314 and 306, shown as 332. In these displays, images may be generated showing promotions, new games, extra winning jackpot events, shows in the casinos, player tracking awards, and generally fun stuff like miniature cartoons.

Displays 314, 332, and 306 may further be used to show a complete bonus or secondary game. One preferred embodiment of such a game is to show a static display of numbers (the numbers would be part of the art on the front of the panel glass) which are bonus multipliers. The numbers are distributed across the glass under which displays 314, 332, and 306 are installed. During bonus play, the electroluminescent displays are used to illuminate each number in a backlit fashion using different colors, each number in quick succession. The bonus round consists of the bonus multiplier numbers being momentarily backlit until lighting stays constant underneath one number; that is the player's winning bonus.

Further bonus plays or games are readily constructible using images that may be displayed directly through the front panel glass, as well backlighting art on the glass. For example, an animated version of a pachinko game could be used as a bonus game on the displays; or, a series of numbers (bonus multipliers or bonus win amounts) appearing to "come out at the player" in quick succession until a winning multiplier "freezes" (number stops changing) could be used; or, other animated sequences resulting in the display of a winning bonus number can be displayed. The present invention enables an unending plethora of visually attractive bonus games or bonus rounds in all their chimeratic splendor to be incorporated directly into the front panel area of reel (or reel tape) gaming machines, not heretofore possible.

Figure 4:
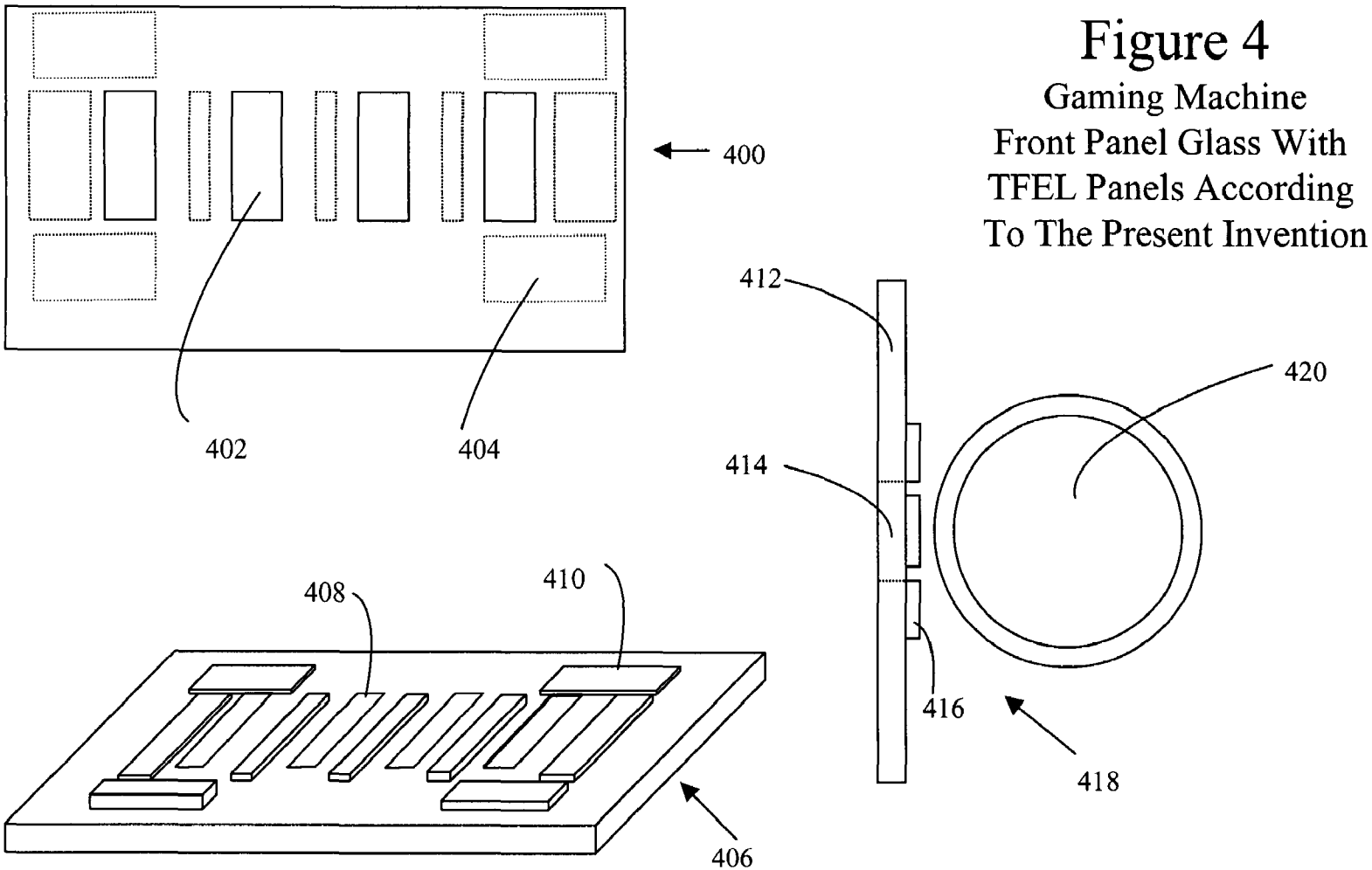

FIG. 4 shows views of an example embodiment of the present invention on front panel glass. Front panel 400 corresponds to the front panel discussed in FIG. 3 (300). Dotted-line boxes indicated by 404 represent electroluminescent displays mounted underneath the front panel glass; solid-line boxes 402 represent reel viewing windows. If a front panel similar to panel 400 is tipped such that the underside (the side away from the player) of the panel is visible, a view such as panel 406 results. Four reel viewing windows 408 are visible, as are mounted electroluminescent displays 410 which correspond to the dotted-line boxes shown on panel 400. These displays will stand slightly proud of the front panel glass; depending on the displays used in a specific game a typical range would be between 0.2" and 0.8". When installed in a reel game, a view similar to 418 results. A set of reels 420 rotate behind front panel glass 412, the front panel 412 having viewing windows 414 allowing a view of each reel (typically one reel through one window). The viewing area is limited to show a specific number of game indicia, the game indicia being printed on the outer circumference of the wheel. Electroluminescent panels 416 may be placed on the backside of front panel 412, as they do not interfere with reels 420. Reels 420 may be physically located where they need to be, namely, close enough to the front panel such that a player can view the game indicia on the reels' circumference, and further with each reel mounted close to the other reels in order to form an easily viewable gaming area.

Figure 5:
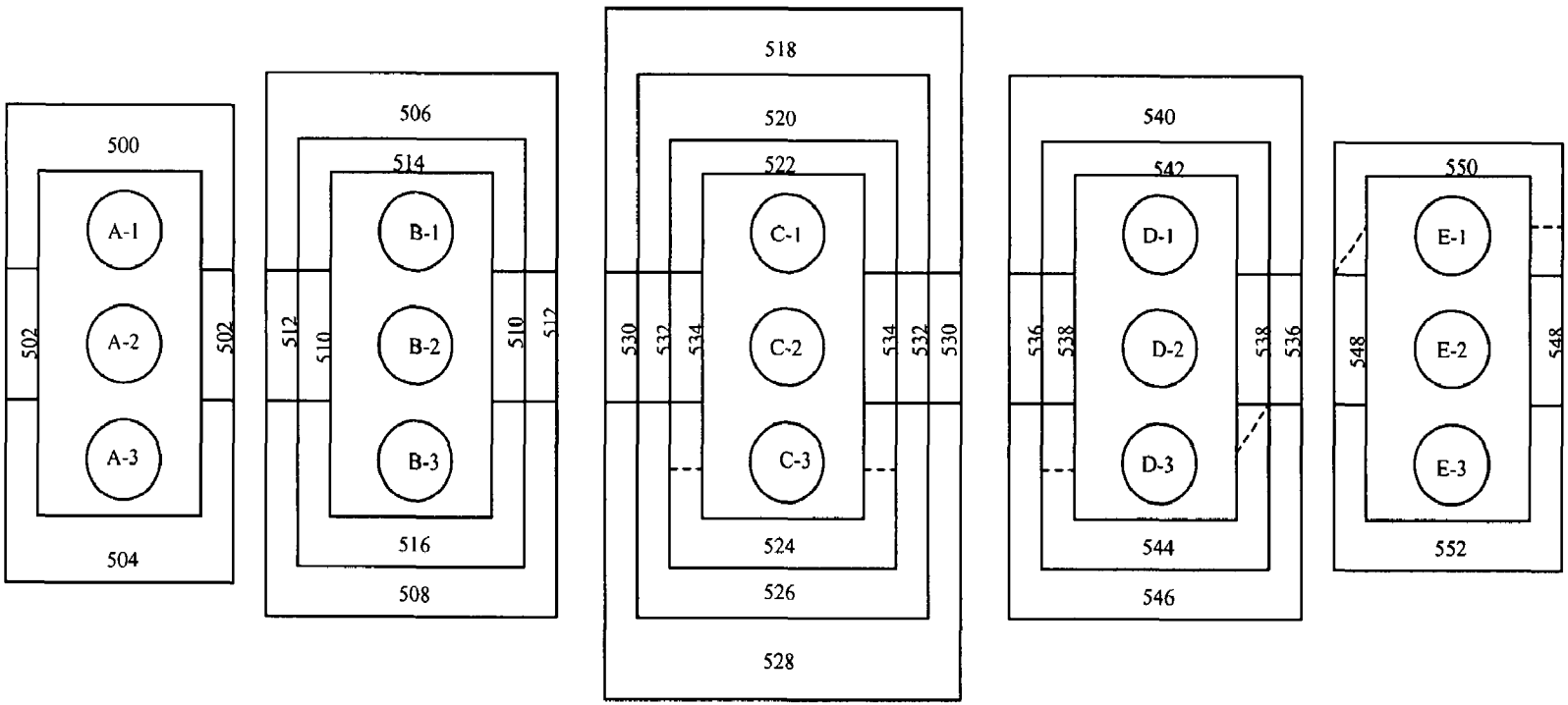
FIG. 5 illustrates game symbol combination indicators using color at least partially surrounding individual game symbols, in accordance with the present invention.

FIG. 5 illustrates another preferred embodiment of the present invention. The ability to use electroluminescent displays immediately surrounding game indicia allows a more colorful method of indicating paylines, while enabling visual winning game indicia indicators not previously known.

FIG. 5 illustrates a gaming machine having 5 reels or reel tapes, with 5 game indicia viewing areas (displays). Each of the game indicia areas allows a player to see 3 individual game indicia. Shown is a 5×3 display. The columns are designated as A through E, and the rows 1 through 3. Thus, the designation B-2 refers to the individual game indicia in column B, second row (middle row, in this case).

Surrounding the 5 slot display areas are electroluminescent displays. For the purposes of this embodiment, the pixels in the electroluminescent displays are grouped into the areas shown in FIG. 5. Each of the visible game indicia has at least one set (defined as a contiguous area as shown in the figure) of pixels on a portion of an TFEL panel associated with it; some have more. On the end rows (end reels), there is one set of pixels in the immediate vicinity of each game indicia. For column A, A-1 has the area 500 in its immediate visual vicinity, A-2 has the two areas shown as 502 in its immediate visual vicinity, and A-3 has area 504 in its immediate visual vicinity. The same layout holds true for the last column, column E. Column B has the indicators discussed as in column A, from B-1 to B-3 being 514, 510, and 516, but in addition has an additional visual indicator (area) for each game indicia. Thus, each individual game indicia in column B has two indicators. In addition to indicators 514, 501, and 516, the B column also has the indicators 506 for B-1, 512 for B-2, and 508 for B-3. Column D is configured similarly to column B, where D-1 has indicators 540 and 542, D-2 has indicators 536 and 538, and D-3 has indicators 544 and 546. The center column, column C, is the most complex. Each individual visible game indicia in column C has three indicators. Game indicia C-1 has indicators 522, 520, and 518; game indicia C-2 has indicators 534, 532, and 530; and game indicia C-3 has indicators 524, 526, and 528. This complex and visually interesting form of indicators is enabled by the use of electroluminescent displays placed around each reel (or reel tape) display.

The game is played when a player makes wagers which enable different numbers of paylines. In one preferred embodiment, shown in FIG. 5, the paylines are very interesting as they are all 3 game indicia paylines. The availability of 5 reels (5 columns of game indicia) means that new combinations of 3 winning indicia may be found and indicated to the player, using the indicators discussed above, creating unique combinations of game indicia not previously available. The game shown in FIG. 5 may be understood as a combination of 3 different 3×3 matrices, each having 3 columns and 3 rows. A first matrix comprises columns A, B, and C; a second matrix comprises B, C, and D; and a third matrix comprises C, D, and E. Any 3 game indicia that would comprise a winning payline in a standalone 3×3 matrix game comprises a winning payline when found in any one of the 3 matrices of the present game. Thus, when designated game indicia show up in designated positions, a winning event based on 3 game indicia is illuminated. As there a 3 sets of columns, there may be winning paylines in any of the 3 column sets (any of the three 3×3 matrices). Examples of winning game indicia combinations include, but are not limited to, A-1, B-1, and C-1; C-3, D-2, and E-1; B-2, C-2, and E-2; B-3, C-2, and D-1; B-1, C-2, and D-1. Since a typical 3×3 matrix game can yield anywhere from 3 paylines (three straight horizontal paylines from right to left) to 27 paylines (including paylines such as A-2, B-3, C-1), the illustrated game, having three 3×3 matrices rather than just one 3×3 may be configured with over 5000 winning combinations. This creates far more excitement for the player, in addition to enabling the casino to choose certain pay table entries for the occasional large win.

In each of the winning payline examples in the last paragraph, the winning payline is shown to the player by using the areas surrounding the game indicia with color indicators to show a winning combination. Thus, column C has three indicators for each individual game indicia (C-1, C-2, C-3) as each game indicia in C has the possibility of being in winning combinations corresponding to each of the three 3×3 matrices visible to a player; columns B and D may each be in two, and columns A and E may be in one. For each logical 3×3 matrix, winning combinations will be flashed or otherwise indicated to the player using a same color.

In one preferred embodiment, the paylines available to a player will be limited to horizontal, 3 game indicia paylines only (i.e., B-3, C-3, and E-3). In this embodiment the winning combinations may be permanently lit while the player watches until the start of the next game event or game play. Each wining game indicia combination may be indicated using a different color. An example having one winning payline from each of the three matrices is: a first win at A-1, B-1, C-1; a second win at B-1, C-1, D-1, and a third win at C-3, D-3, and E-1. If matrix A, B, C is indicated by red, matrix B, C, D indicated by green, and matrix C, D, E is indicated by yellow, then areas 500, 514 and 522 could be red; area 506, 520, and 540 could be green, and areas 524, 544, and 550 could be yellow. This visually indicates to a player, using the surrounding TFEL displays, where the winning combinations are. The player simply looks to see which game indicia have like colors in the areas near the them.

In more complex games allowing complex paylines, a preferred embodiment will be to use a combination of indicators as shown in FIGS. 3 and 5; that is, both the individual paylines shown in FIG. 3 and the areas shown in FIG. 5. After a game event in a game configured as in FIG. 5, a color will be used to represent one 3×3 matrix, with a payline within the color showing the actual payline. Thus, if green were used for the 3×3 matrix comprising columns C, D, and E, then a payline of C-3, B-3 and E-1 would be shown by lighting areas 550, 544, and 524 with green, and further having a black (or other contrasting color) line in the area crossing or connecting the winning game indicia areas. This is shown using the dotted lines in the listed areas.

Figure 6:
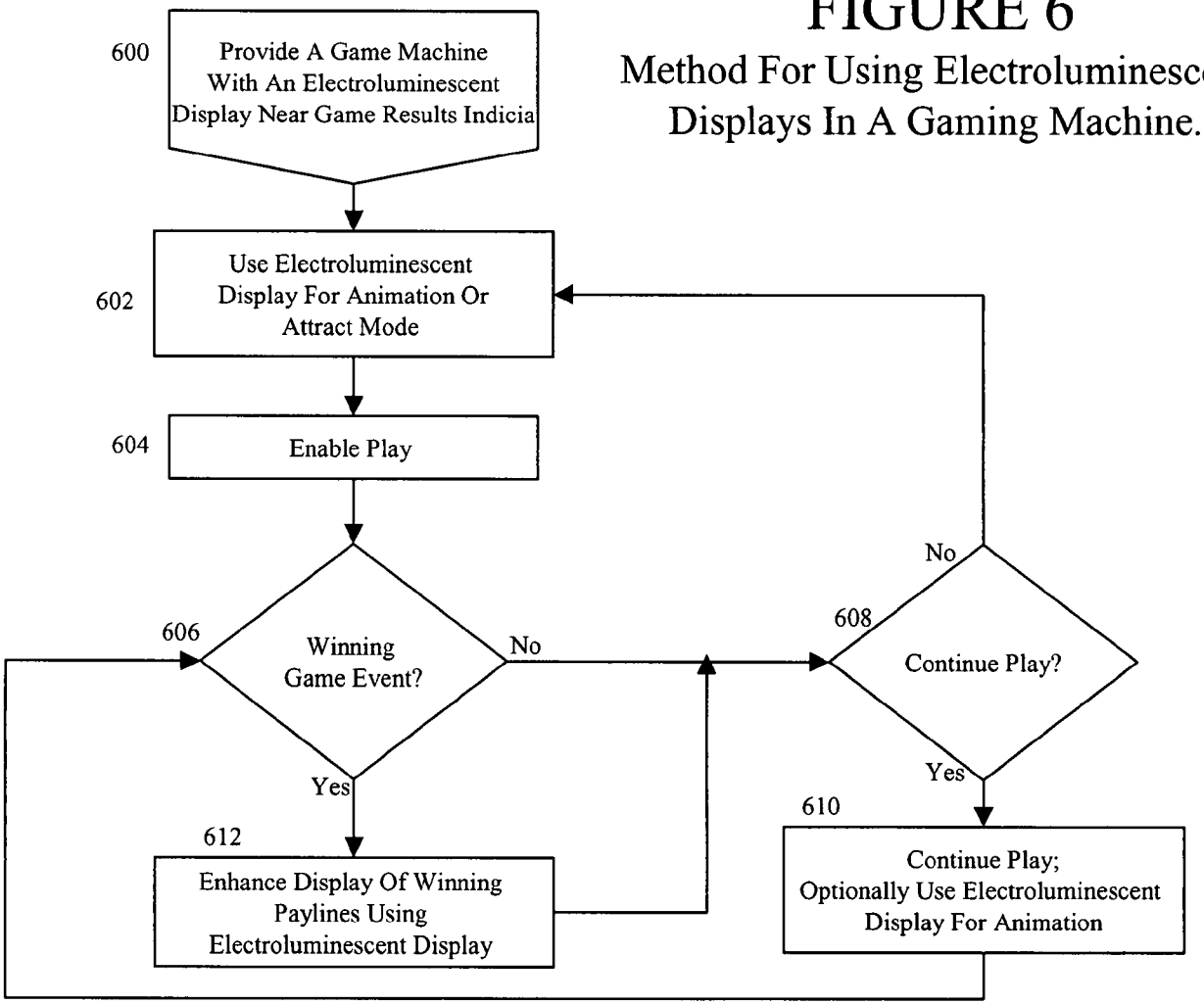
FIG. 6 is a block diagram showing a method for using electroluminescent displays in a gaming machine, in accordance with the present invention.

FIG. 6 illustrates a method for using electroluminescent displays in a gaming machine. Starting box 600 is the initial starting point, the actions corresponding to this box being to provide a gaming machine having at least one electroluminescent panel operably disposed within the gaming machine and visually near the game results display area. Further, the panel must be positioned such that a player can make a visual association between images displayed on the panel and at least one of the visible game indicia. In one preferred embodiment there will be a visual association between any one game indicia and at least one portion of at least one panel. Box 600 is left and box 602 entered.

The actions associated with box 602 are to use the electroluminescent display for player enjoyment and player attract mode. This includes but is not limited to displaying possible rewards and benefits of the game, promotions of other events in the casino, news, stock market displays, jokes, cartoons, and generally fun stuff to watch. Box 602 is left and box 604 is entered when play is enabled.

The actions corresponding to box 604 include a player enabling the game for play. This may be the presentation of a voucher to an player I/O device, cash input to the gaming machine, EFT transfer, or any other means of establishing game play credits on the gaming machine. Further, game play starts in box 604. Diamond 606 is now entered.

The decision corresponding to diamond 606 is to determine if a game winning event has occurred. This could be any game winning event as defined by the game itself; typically this will include a set of game indicia having a certain special relationship to each other defining a winning payline thereby. If there is a winning event, diamond 606 is left via the "YES" exit to box 612. The actions corresponding to box 612 include enhancing player recognition of any and/or all paylines using all available electroluminescent displays operable within the gaming machine having visual proximity to the game indicia. This includes showing paylines by using actual lines, color indicia, or other visual means, over that available in the machine without the display(s). Box 612 is left for diamond 608.

The decision corresponding to diamond 608 are the player continuing to play or leaving the game. If the player decides to leave the game, the "NO" exit is taken from diamond 608 and box 602 is re-entered, continuing the process with the actions corresponding to that box.

If the player wishes to continue to play, the "YES" exit is taken to box 610. The actions corresponding to box 610 include the player continuing play by invoking a next game event, and, optionally, using the electroluminescent display (s) for player amusement and attract mode. As soon as a player has triggered a next game event, box 610 is left and diamond 606 is re-entered.

Returning to diamond 606 from above and taking a different exit path, if the game event had no winning event then the "NO" exit is taken to diamond 608. The actions corresponding to diamond 608 are explained immediately above; the player decides to keep playing or not.

Figure 7:
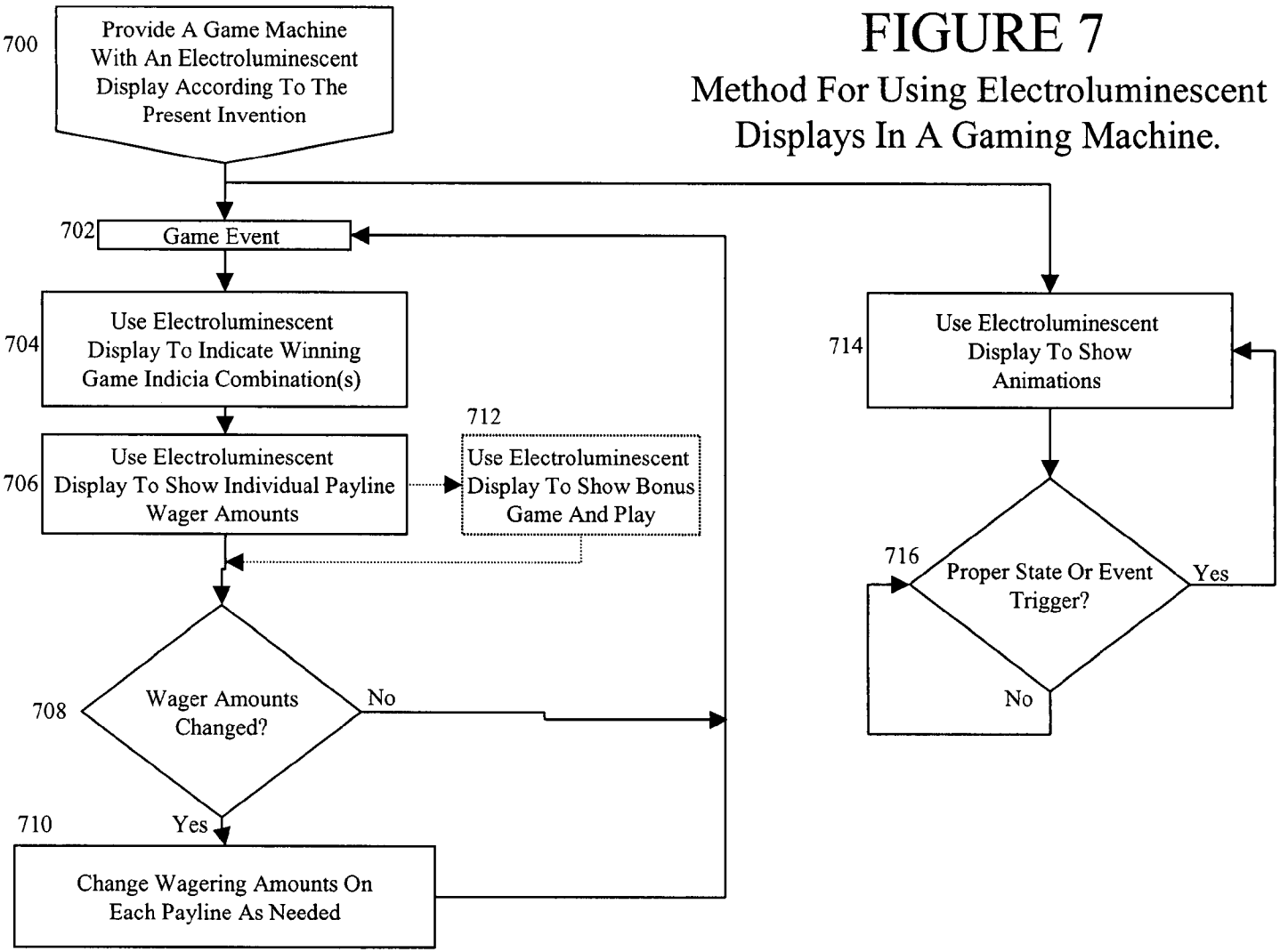
FIG. 7 is a block diagram showing a further method for using electroluminescent displays in a gaming machine, in accordance with the present invention.

FIG. 7 further elaborates the use of electroluminescent displays in indicating paylines and in the use of attract modes. Starting at block 700, a gaming machine having electroluminescent panels in accordance with the present invention is supplied or present. Block 700 is left and block 702 entered. The actions corresponding to block 702 are to wait until a game event occurs. A game event means a game play, a game play occurring after a player has enabled game play by using credits, vouchers, EFT, chips, etc. Further note that after leaving block 700, there is an arrow going to block 714. This shows a concurrent event. The process represented by block 714 and diamond 716 is triggered, looping until the game is shut off.

The actions corresponding to block 714 are to use any available electroluminescent panels to show an animation, used as an attract mode feature. Upon the gaming machine being powered up and before the first game event is triggered, this loop will be started. One preferred embodiment will use the electroluminescent panels to show fixed-sequence animations; this is an action corresponding to block 714. Fixed-sequence animations are animations that use a series of pre-defined images, typically very few (from as few as 3 to perhaps a dozen), and by showing the images on the display, in sequence, give the appearance of an animated picture. Thus, the actions corresponding to block 714 include sending a sequence of pre-defined images to the display or displays, creating an attract-mode animation sequence thereby. Once completed, block 714 is left for diamond 716.

The decision corresponding to diamond 716 is to check the current state of the gaming machine, and if a specified state or trigger event has occurred, take the "YES" exit back to 714, thus triggering another animated display. If the state of the machine is such that an animation sequence should not be started (for example, a player involved in a bonus game using the electroluminescent displays), or if a triggering event has not been set (i.e., a "do animation" bit in a status word is set to j), then the "NO" exit is taken, looping back into diamond 716 which repeats its checks until a game state or triggering event is found. The loop continues as long as the gaming machine is powered up.

Note that this loop contains the ability to enable multiple animation sequences, triggered by different states or flags. For example, if there is an animation sequence designed to be played after a player wins a bonus round of play, then the "event trigger" may comprise the setting of designated bits in a word, which when checked (as part of a regular polling process) by the software looping in 716, will then invoke a particular animation sequence. The use of a plurality of bits for the trigger enables not only the invocation of an animation sequence, but the ability to choose amongst several choices of animation sequences.

Returning to block 702, after the occurrence of a game event block 704 is entered. The actions corresponding to block 704 are to use the electroluminescent display(s) to show any winning game indicia combinations. There may not be any. In a typical reel game, such combinations are called paylines, but may be defined in any way that makes the game interesting to players (since the combinations may now be identified to the player in a better manner than previously). For example, it may be that a player may win something if a "block" of cherries occurs, where a "block" is any four cherry game indicia that form a 2×2 matrix, anywhere on the games display. The game indicia forming a winning combination may be illuminated using lines, colors, boundary colors, and for multiple winning combinations may be shown in a sequential manner in order to allow the player to cognize each winning group.

After indicating the winning combinations in some manner, block 704 is left and block 706 is entered. The action corresponding to block 706 are those of one preferred embodiment; note that there are other preferred embodiments which will not make use of 706, 708, 710, and 712 (704 would loop back to 702). In block 706, the actions include showing an amount wagered per paylines, or an amount wagered for each particular payline, at one end of each payline.

Dotted-line box 712 may or may not be entered, depending on the implementation of bonus rounds in the particular game in use. If there are bonus rounds a player may win on the game in use, and if a bonus round has been triggered, then box 712 is entered. The actions corresponding to box 712 are to invoke the bonus game and use the electroluminescent display(s) to show the entire bonus round (no other gaming apparatus is needed, for example, no top box is needed). After the completion of the bonus round (if any), and/or the completion of the actions 706, diamond 708 is entered.

The decision corresponding to diamond 708 is to see if the player has changed any wagering amounts. If so, then the "YES" exit is taken to block 710, where the wagering amounts shown at the end of each payline, or the affected paylines, is changed accordingly. After that, block 712 is left block 702 re-entered. If there is no change in wagering amounts, then the "NO" exit is taken out of diamond 708, leading directly back to block 702.

The use of electroluminescent displays has been described primarily for the use in gaming machines, located in close visual proximity to the gaming machine's game indicia. It is fully contemplated that the above discussed displays will readily be usable in prize kiosks and other electronic devices found in casinos.

The present invention has been partially described using a flow diagram. As will be understood by a person of ordinary skill in the art and with the benefit of the present disclosure, steps described in the flow diagram can vary as to order, content, allocation of resources between steps, times repeated, and similar variations while staying fully within the inventive concepts disclosed herein.

Accordingly, it will be seen that this invention provides a system and method for providing game play enhancement using electroluminescent displays in a gaming machine in close visual proximity to the game indicia area. In addition, new attract mode features are thereby made available. Although the description above contains certain specificity, the described embodiments should not be construed indicating the scope of the invention; the descriptions given are providing an illustration of certain preferred embodiments of the invention. The scope of this invention is determined by the appended claims and their legal equivalents.

What is claimed is:

1. A gaming machine configured to allow a player to play at least one game, wherein game play results of the gaming machine are shown using a plurality of base game indicia visible to the player in a game indicia display area, the game indicia display area comprising a front panel having one or more transparent or cutout areas through which the base game indicia are visible, or at least partially surrounding the plurality of base game indicia next to which the base game indicia are visible, the gaming machine comprising:

at least one electroluminescent (EL) panel addressable by pixels and operably, fixedly, and visibly attached to the front panel proximate to the game indicia display area to form a visual association between the base game indicia displayed in the game indicia display area and at least one portion of the at least one EL panel wherein the EL panel does not overlay the base game indicia and the EL panel is not used to display the base game indicia in a first area; and an EL panel configured to allow display of a bonus game upon a bonus game trigger event in a second area, wherein the bonus game is not a duplicate of the base game, wherein the EL panels in the first and second areas are separate and distinct, and wherein the first and second areas are enabled for their respective uses simultaneously and independently.

2. The gaming machine of claim 1 further configured such that at least one of the at least one EL display is visually proximate to each of the plurality of game play results base game indicia.

3. The gaming machine of claim 2 further configured such that the at least one EL display shows at least one winning event amongst the-plurality of game play results base game indicia using at least one visual indicator, indicating a relationship between the plurality of game play indicia comprising a winning event.

4. The gaming machine of claim 2 further configured such that the at least one EL display visually indicates a relationship between any base game indicia that correspond to a game winning event.

5. The gaming machine of claim 4, wherein the visually indicated relationship further comprises displaying a line between the base game indicia corresponding to the game winning event.

6. The gaming machine of claim 4, wherein the visually indicated relationship further comprises displaying a boundary partially surrounding each of the base game indicia corresponding to the winning event, wherein the boundary uses color as an indicator.

7. A method for using at least one electroluminescent display in a gaming machine configured to allow a player to play at least one game and further configured to show game play results as a plurality of base game indicia visible to the player in a game indicia display area, the game indicia display area comprising a front panel having one or more transparent or cut-out areas through which game indicia are visible, or at least partially surrounding the plurality of base game indicia next to which the base game indicia are visible, and wherein the game play results are at least in part determined by a random event, the method comprising:

configuring at least one electroluminescent (EL) display addressable by pixels in the gaming machine such that the at least one EL display is in close visual proximity to the plurality of base game indicia by being affixed to the front panel but not overlaid on top of the base game indicia and is not used to display the base game indicia in a first area;

allowing a game play and displaying the plurality of base game indicia resulting from the game play;

determining which displayed plurality of base game indicia, resulting from the game play, are winning combinations if any;

indicating at least one winning base game indicia combination using the first area, if there is a winning combination;

playing enabling play of a bonus game on an EL displays wherein the EL panel is used to display the bonus game in a second area upon a bonus game trigger event in the game play, wherein the bonus game is not a duplicate of the base game, wherein the EL panels in the first and second areas are separate and distinct, and wherein the first and second areas enabled for their respective uses simultaneously and independently.

8. The method of claim 7, wherein indicating at least one base game indicia combination further comprises indicating all winning base game indicia combinations using the electroluminescent display, if any.

9. The method of claim 8, wherein indicating winning base game indicia combinations further comprises using colored areas as indicators.

10. The method of claim 8, wherein indicating winning base game indicia combinations further comprises using lines displayed in the at least one EL display to indicate which individual base game indicia comprise each winning base game indicia combination.

11. A method for enticing players to play a gaming machine having at least one electroluminescent (EL) display addressable by pixels affixed to a front panel and configured to allow a player to play at least one game and further configured to show game play results as a plurality of base game indicia visible in a game indicia display area, the game indicia display area comprising the front panel having one or more transparent or cut-out areas through which the base game indicia are visible, or at least partially surrounding the plurality of game indicia, enabling the base game indicia to be viewed through or next to the front panel, and wherein the game play results are at least in part determined by a random event, the method comprising:

allowing a player to play a game with the game results at least partially shown as individual base game indicia;

illuminating areas visually near the individual base game indicia using the at least one EL display located in a first area and corresponding to the game play results, wherein the illuminated area is not overlaid on top of the base game indicia and does not form part or all of the base game indicia; and enabling play of a bonus game, wherein at least one EL panel is used to display the bonus game in a second area upon a bonus game trigger event in the game, wherein the bonus game is not a duplicate of the base game, wherein the EL panels in the first and second areas are separate and distinct, and wherein the first and second areas enabled for their respective uses simultaneously and independently.

12. The method of claim 11, wherein illuminating areas further comprises using same colors to indicate a group of individual base game indicia which form a winning game event.

13. The method of claim 11, wherein illuminating areas further comprises turning the illuminated areas repeatedly on and off where the illuminated areas are visually near winning base game indicia.

14. The method of claim 11, wherein illuminating areas further comprises indicating winning base game indicia combinations by illuminating lines that visually indicate each winning base game indicia.

15. The method of claim 11 further comprising:

displaying results from the game and the bonus game in an area having visual elements from both games, the area comprising a third area different than the first and second areas.

16. A gaming machine having at least one electroluminescent (EL) display addressable by pixels affixed to a front panel, the front panel comprising a game indicia display area, the game indicia display area comprising one or more transparent or cut-out areas or at least partially surrounding the base game indicia, and allowing the base game indicia to be viewable through or next to the front panel, the gaming machine comprising:

means for allowing a player to play a game having game play results, wherein the game play results are at least in part determined by a random event, and wherein the game play results are at least partially shown as a selection of base game indicia;

means for illuminating areas visually near the selection of base game indicia using the at least one EL display such that the illuminated area is not overlaid on top of the base game indicia and does not form part or all of the base game indicia in a first area;

means for using the first area to highlight winning results in the base game indicia;

means for enabling play of a bonus game, wherein at least one EL panel is used to display a bonus game in a second area, wherein the bonus game is not a duplicate of the base game, wherein the at least one EL panel in the second area is separate and distinct from the at least one EL display from the first area; and wherein the first and second areas are viewable simultaneously and are usable independently.

17. The gaming machine of claim 16, wherein the means for illuminating areas to highlight winning results further comprises using same colors to indicate a group of individual game indicia which form a winning game event.

18. The gaming machine of claim 16, wherein the means for illuminating areas to highlight winning results further comprises turning the illuminated areas repeatedly on and off visually near winning game indicia.

19. The gaming machine of claim 16, wherein the means for illuminating areas to highlight winning results further comprises indicating winning game indicia combinations by illuminating lines that visually indicate each winning game indicia.

* * * * *

UNITED STATES PATENT AND TRADEMARK OFFICE

CERTIFICATE OF CORRECTION

PATENT NO. : 7,335,101 B1
APPLICATION NO. : 10/119279
DATED : February 26, 2008
INVENTOR(S) : Robert A. Luciano, Jr. et al.

It is certified that error appears in the above-identified patent and that said Letters Patent is hereby corrected as shown below:

Column 1
In line 59, replace “wining” with --winning--
In line 62, replace “machine” with --machines--

Column 2
In line 48, replace “FIG. 3” with --FIG. 4--

Column 3
In line 11, replace “an” with --a--
In line 46, replace “they” with --the--

Column 4
In line 28, replace “were” with --where--

Column 7
In line 3, replace “an” with --a--
In line 46, replace “a” with --are--

Column 8
In line 8, replace “wining” with --winning--
In line 55, replace “an” with --a--

Column 9
In line 6, replace “are” with --is--

Signed and Sealed this

First Day of July, 2008

JON W. DUDAS
*Director of the United States Patent and Trademark Office*